US005647409A

United States Patent [19]

Christ et al.

[11] Patent Number: 5,647,409

[45] Date of Patent: Jul. 15, 1997

[54] ON-SITE SYRINGE FILLING APPARATUS FOR VISCOELASTIC MATERIALS, AND CORRESPONDING METHOD FOR ON-SITE SYRINGE FILLING

[75] Inventors: F. Richard Christ, Laguna Beach; Erick F. Fischer, Long Beach; Kenneth E. Kadziauskas, Laguna Niguel, all of Calif.

[73] Assignee: Allergan, Waco, Tex.

[21] Appl. No.: 416,101

[22] Filed: Apr. 4, 1995

[51] Int. Cl.[6] ..... B65B 1/04

[52] U.S. Cl. ..... 141/27; 141/67; 141/369; 604/407

[58] Field of Search ..... 141/2, 25, 26, 141/27, 67, 94, 113, 312, 351, 369, 370; 604/407

[56] References Cited

U.S. PATENT DOCUMENTS

| | | | |
|---|---|---|---|
| 3,807,131 | 4/1974 | Samson et al. | 141/25 |
| 3,812,890 | 5/1974 | Haas et al. | 141/94 |
| 3,935,883 | 2/1976 | Stach et al. | 141/27 |
| 4,328,803 | 5/1982 | Pape | 128/276 |
| 5,203,507 | 4/1993 | Matthews | 141/27 |

*Primary Examiner*—Henry J. Recla
*Assistant Examiner*—Steven O. Douglas
*Attorney, Agent, or Firm*—Howard R. Lambert; Robert J. Baran; Timothy J. King

[57] ABSTRACT

An automated, syringe filling apparatus is disclosed for the on-site filling of syringes with a viscoelastic fluid material from a supply reservoir. A housing has a port for receiving the outlet end region of the viscoelastic supply reservoir and a retainer is provided for releasably retaining a conventional syringe to be filled from the viscoelastic supply reservoir. A flexible plastic tube, preferably formed as part of the viscoelastic supply reservoir, is used to interconnect the supply reservoir with a filling end of a syringe retained in the syringe retainer. A peristaltic pump mounted in the housing has a rotating head with a plurality of rollers which force the viscoelastic material through the tube from the supply reservoir into a retained syringe when the tube is locked between the pump head and a back-up member. Electric pump controls include a timer calibrated for causing the automatic filling of the syringe with predetermined amounts of viscoelastic material from the supply reservoir. The controls include a sensor that automatically shuts off the pump when a syringe being filled is filled to a preestablished maximum level. An air pump is provided for pressurizing the viscoelastic supply reservoir to aid in the viscoelastic pumping operation and insure against air voids being formed in a syringe being filled. A corresponding method is disclosed for the on-site filling of a syringe with a viscoelastic fluid form a supply reservoir.

29 Claims, 4 Drawing Sheets

POWER
PRIME
H

ON-SITE SYRINGE FILLING APPARATUS FOR VISCOELASTIC MATERIALS, AND CORRESPONDING METHOD FOR ON-SITE SYRINGE FILLING

BACKGROUND OF THE INVENTION

FIELD OF THE INVENTION

The present invention relates generally to the field of medical apparatus, more particularly, to surgical apparatus, and still more particularly to syringes used in connection with surgical processes which require the injection of viscoelastic materials.

BACKGROUND DISCUSSION

A number of types of surgical procedures on human patients require the injection—usually by the use of a syringe—of a selected amount of a biocompatible viscoelastic material or "fluid" (i.e., highly viscous fluid) for such purposes as protecting sensitive adjacent tissue from accidental, surgically-induced trauma and/or for the maintaining or positioning of selected tissue out of interference with the surgical procedure being performed. After the surgical procedure is completed, the viscoelastic fluid is usually removed, but in some circumstances, at the surgeon's discretion, may be left in situ if its continued presence can be beneficial to the patient and if the material is of a biocompatible composition, for example, a hyaluronic acid based material, that can be absorbed or assimilated by the patient's body without adverse effects.

As an illustrative example of such surgical procedures, small amounts of a viscoelastic fluid are typically injected into a patient's eye during a surgical procedure in which the patient's diseased or injured ocular crystalline lens which is impairing or has destroyed the patient's vision is removed. In conjunction with this type of surgical procedure, called phakic surgery, an artificial, prosthetic lens—commonly called an intraocular lens (IOL)—is ordinarily implanted in the eye to restore the patient's vision, the IOL usually being implanted in the region from which the diseased or damaged natural lens has been removed. Typically, but not necessarily, the removal of a defective natural lens, which may be a result of cataract, and the implanting of a replacement IOL is performed during a single phakic procedure.

In such phakic surgical processes, a viscoelastic material is often injected into the patient's eye by means of a small-volume hypodermic syringe, to physically protect the delicate, non-regenerative endothelial cell layer of the cornea from being damaged, for example, by accidental contact by instruments being used in the surgery, by broken pieces of the natural lens being removed and/or by the IOL when it is being implanted into, or positioned in, the eye. In a separate procedure, viscoelastic material may also be injected into a patient's eye to prevent collapse of the eye due to loss of the vitreous from the eye during surgical operations.

Most viscoelastic materials or "fluids" presently used in conjunction with such phacic surgery are based on high molecular weight hyaluronic acid-usually in the 500,000 to 2,000,000 plus molecular weight range—in a suitable buffering solution. The hyaluronic acid, which is biocompatible since it is naturally present in small concentrations in normal human eyes, provides the viscoelastic properties of the fluid, which typically has a dynamic viscosity of about 40,000 cps at one sec.$^{-1}$, as measured by conventional viscosity measuring procedures. Exemplary of such hyaluronic acid-based viscoelastic fluids are VITRAX®, HEALON®, VISCOAT® and AMVISC®, which are marketed, respectively, by Allergan, Inc., Kabi Pharmacia, Alcon Laboratories and Iolab Corporation.

In contrast with low-viscosity, injectable pharmaceutical fluids (for example, vaccines and antibiotics) that are ordinarily provided to medical professionals in sealed bottles from which hypodermic syringes are filled just before injection of the fluid, so far as is known to the present inventor, injectable viscoelastic fluids of the above-mentioned types are always provided in sterile, single-use syringes that are pre-filled by the viscoelastic material manufacturers. This is because the high viscosity of the viscoelastic fluids has heretofore made the on site filling of commonly-used syringes with viscoelastics too difficult to be practical.

However, the availability of viscoelastic surgical fluids only in "factory-filled" syringes is not entirely satisfactory for many medical professionals since for practical reasons and at least for phacic surgical procedures, the syringes are ordinarily factory-filled by each manufacturer in only one or two of the most commonly-used amounts of viscoelastic-typically between about 0.4 ml and about 1.0 ml.

However, these pre-filled syringes of viscoelastic materials often do not contain precisely the amount of viscoelastic material that surgeons want or need for their individual surgical procedures. If, as an illustration, a surgeon determines that 0.75 ml of viscoelastic material is needed for a particular ophthalmic surgical procedure, he or she may use only part of a available 1.0 ml syringe. The remaining viscoelastic material in the syringe must be discarded since it cannot, for patient safety reasons, be used in another surgical procedure.

A possible alternative would be for the surgeon to use several syringes each containing smaller than needed amounts of viscoelastic material but in the aggregate containing about the required amount. This alternative is, however generally undesirable because of extra cost associated with using two, or possibly more, factory-filled viscoelastic syringes, including related packaging and other costs, and possibly also because of the additional steps and "time-in-the-eye" required.

Another possible alternative would be for the surgeon to settle for a lesser amount of viscoelastic material than his or her judgment calls for so that a single syringe having a less than desired volume of viscoelastic material can be used. Although the temptation to settle for less viscoelastic material than desired might accordingly be there, most surgeons would be expected to consider this alternative an unethical or unsafe surgical practice.

Consequently, the most common procedure is thus the discarding or wasting of relatively small amounts of viscoelastic material in many or possibly most ophthalmic surgical procedures. This practice would not appear to those unfamiliar with current strict medical reimbursement policies to be of much concern. However, the reality is that all surgically-related costs are coming under close scrutiny by medical cost reimbursers and any wasting of materials is, at least now, considered very undesirable.

Relative to the cost of such above-described wastage of viscoelastic materials, factory-filled viscoelastic syringes of the mentioned sizes currently range in cost from a low of about twenty or thirty dollars to as much as about eighty dollars or even about one hundred dollars, depending to a large extent on quality (real or perceived). This relatively high cost is due to the extensive processing required to obtain high purity, sterile hyaluronic acid, which is obtained either from rooster combs or biological fermentation.

Thus, a wasted one-fourth of the viscoelastic material in a factory-filled syringe constitutes a "loss" of between about seven or eight dollars to as much as about twenty or twenty-five dollars. On an individual basis, considering the overall cost of ophthalmic surgical procedures, this amount of loss seems small. However, assuming about a ten dollar loss of viscoelastic on only about half of the 1.7 million cataract surgical procedures performed annually in the United States alone, in the aggregate wasted viscoelastic material in cataract surgical procedures amounts to about 8.5 million dollar loss, for which the public ultimately pays.

For these and other significant reasons-including convenience and the ability to reduce office, clinic and hospital inventories of factory-filled viscoelastic syringes-the present invention provides an apparatus enabling the practical on-site filling of standard syringes with viscoelastic material from a supply reservoir of the material. The apparatus enables syringes to be filled with the precise amounts of viscoelastic material desired or required by surgeons for particular surgical procedures, and may be done just prior to commencement of the surgery.

SUMMARY OF THE INVENTION

In accordance with the present invention, there is provided a syringe filling apparatus for filling syringes with a viscoelastic material. The apparatus comprises a receiving port configured for receiving an outlet end region of a supply reservoir of viscoelastic material and a syringe retainer configured for receiving and releasably retaining a discharge end (i.e., needle attaching end) region of a conventional medical syringe to be filled with viscoelastic material from the received viscoelastic supply reservoir. The apparatus further comprises viscoelastic material transfer means connected for transferring viscoelastic material from the viscoelastic supply reservoir received in the receiving port to the discharge end region of a syringe retained in the syringe retainer and from such end region into the syringe for the filling thereof.

In accordance with a preferred embodiment of the invention, the apparatus further comprises a housing and a fluid transfer conduit, preferably a flexible plastic tube, disposed in the housing for interconnecting the outlet end region of a viscoelastic supply reservoir installed in the receiving port with the discharge end region of a syringe installed in syringe retainer.

In conjunction with such flexible plastic transfer tube, the viscoelastic material transfer means preferably include a peristaltic pump with a rotatable pump head having mounted thereto a plurality of circumferentially spaced-apart pumping rollers, the pump being installed so that at least the pump head is inside the housing.

A back-up member is mounted in the housing adjacent the pump head for pivotal movement between an open position in which a region of the transfer tube can be positioned between regions of the back-up member and the pump head and a closed position in which rotation of the pump head by operation of the pump then causes the pumping rollers to sequentially compress regions of the transfer tube between the pump head and the closed back-up member in a manner causing the pumping of viscoelastic material through the tube from a viscoelastic supply reservoir received into the receiving port into a syringe retained in the syringe retainer.

The peristaltic pump is connected for being electrically operated from an external electrical power source, in which case the apparatus includes electrical controls connected for controlling the operation of the pump. The electric controls are preferably configured for enabling the separate priming operation of the pump so as to initially fill the transfer tube with viscoelastic material from a supply reservoir of viscoelastic material received in receiving port before a syringe is installed in the syringe retainer.

In addition, the electrical controls preferably include a selective fluid pump control, for example, a pump timer, with associated index (timer) markings related to the amount of viscoelastic material to be transferred by the fluid pump from a viscoelastic supply reservoir received in the receiving port into a syringe installed in the syringe retainer, thereby enabling the syringe to be filled with a pre-selected amount of viscoelastic material from the supply reservoir.

The electrical controls preferably include a syringe fill level sensor connected for sensing when a syringe being filled from the viscoelastic supply reservoir has been filled to a preestablished level and for then automatically cutting off the fluid pump even if the pump timer has not timed out.

The apparatus may advantageously include pressurizing means, for example, an air pump, for pressurizing the viscoelastic supply reservoir to insure that no air voids occur in the transfer tube during the syringe filling operation. In such case, the electric controls are connected for operating the air pump when the fluid pump is operating. A pressure relief valve is preferably provided on the viscoelastic supply reservoir to prevent over pressurizing of the reservoir.

The flexible transfer tube may advantageously be integrally formed at the outlet end region of the viscoelastic supply reservoir that is received into the receiving port. In such case, the transfer tube is part of the reservoir and is discarded with the reservoir when the reservoir is emptied after it has been used to fill a number of syringes.

There is provided a corresponding method for the on-site filling of a syringe with a viscoelastic material. The corresponding method comprises the steps of providing a supply reservoir of a viscoelastic material to be used in filling a syringe, connecting the needle-attachment end of a syringe to the outlet end of the reservoir through a flexible fluid transfer tube, and squeezing the connecting tube in a manner causing the flow therethrough of viscoelastic material from the viscoelastic supply reservoir into the syringe. The method preferably includes the step of initially filling the tube with viscoelastic material from the supply reservoir before connecting a syringe to tube and may include the step of pressurizing the viscoelastic supply reservoir so as to insure against the forming of air voids in the transfer tube and the syringe during the syringe filling operation.

Further, the method preferably includes the step of forming the flexible transfer tube integrally with the viscoelastic supply reservoir so as to be disposable with the supply reservoir after the viscoelastic material has been emptied from the supply reservoir by filling a number of syringes therefrom. Still further, the method preferably comprises the step of releasably retaining the syringe in a fixed position relative to the viscoelastic supply reservoir while the syringe is being filled with viscoelastic material from the supply reservoir.

In accordance with a preferred embodiment, the step of squeezing the transfer tube in a manner causing the flow therethrough of viscoelastic material from the viscoelastic supply reservoir into a syringe includes pumping the viscoelastic material through the transfer tube with a peristaltic pump having pump head rollers for causing a sweeping compression of the tube when the pump is operated.

Still further included in the method is the step of controlling the operation of the pump so that only a predetermined amount of viscoelastic material is pumped into the connected syringe.

There is thus provided an apparatus and corresponding method for the controlled, on-site filling of syringes with predetermined amounts of viscoelastic materials from a supply reservoir of viscoelastic material.

BRIEF DESCRIPTION OF THE DRAWINGS

The present invention can be better understood from a consideration of the accompanying drawings in which.

DESCRIPTION OF THE PREFERRED EMBODIMENT

Figure 1:
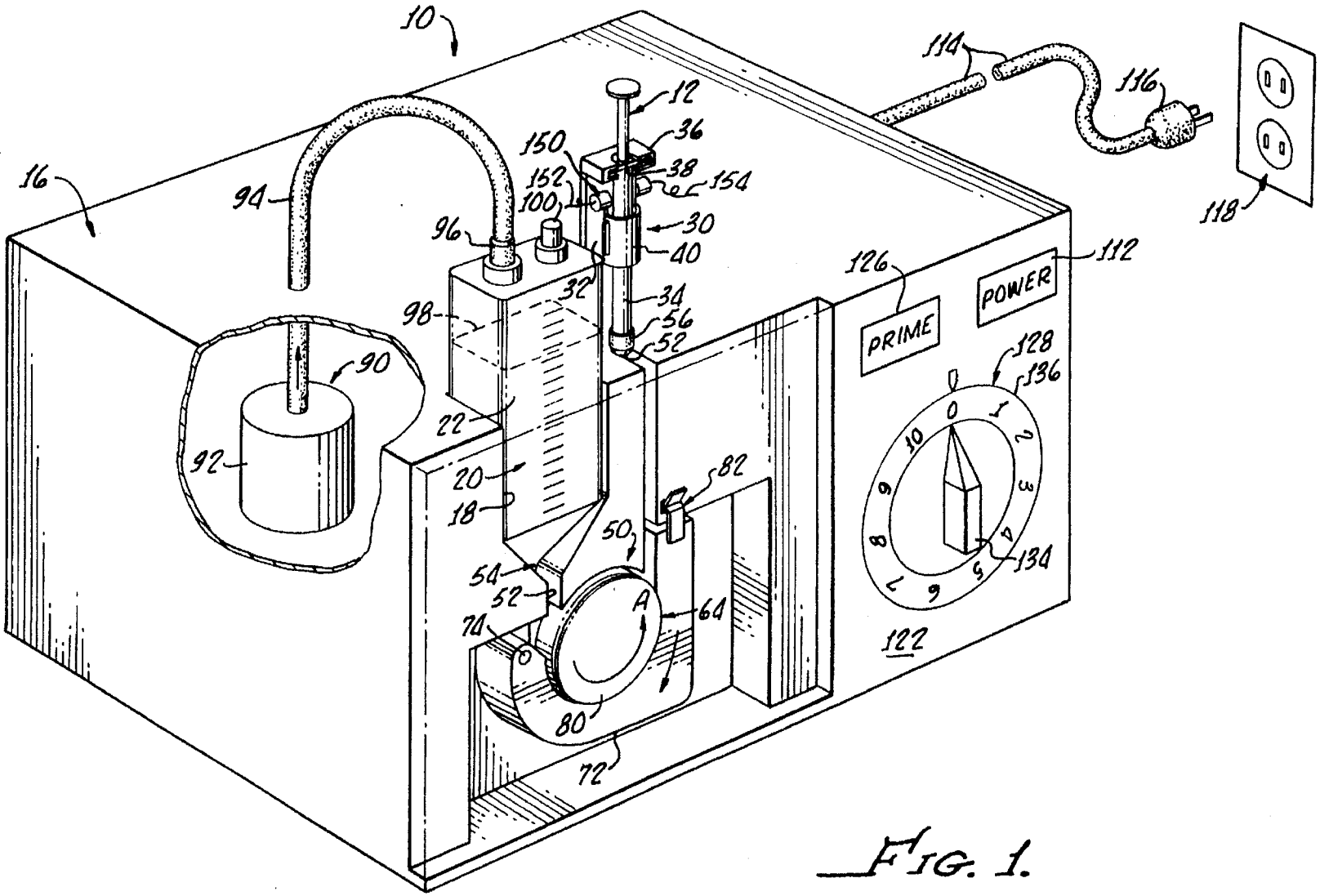
FIG. 1 is a perspective drawing of an on-site syringe-filling apparatus for viscoelastic fluids in accordance with a preferred embodiment of the invention, showing a housing having a receiving port for receiving a disposable viscoelastic fluid supply reservoir and a syringe retainer for releasably retaining a conventional, single-use syringe to be filled from the supply reservoir, and further showing means for pressurizing the viscoelastic supply reservoir and showing portions of a viscoelastic fluid transfer pump.

There is shown in FIG. 1, an automated or power-operated syringe filling apparatus 10, which is especially configured for the "on-site" filling of a conventional medical syringe 12 from a source or supply reservoir 14 of viscoelastic material, such as VITRAX®, HEALON® OR AMVISC®. It is to be understood that the term "on-site" is used herein in a broad sense as meaning in a medical doctor's office, a medical laboratory or clinic, a surgical or operating room, a hospital, or the like, ordinarily in proximity to where a patient is undergoing or may undergo a surgical procedure in which the viscoelastic material is intended to be used. Apparatus 10 is, of course, not precluded from being used in small-scale viscoelastic manufacturing facilities.

Apparatus 10 comprises a housing 16 which has a downwardly-opening port 18 for receiving at least lower regions 20 of viscoelastic supply reservoir 14, which may, for example (with no limitation intended or implied) contain about 50 to 100 ml of viscoelastic material 22. Attached to housing 16 in a spaced-apart relationship with respect to viscoelastic supply reservoir receiving port 18, is a syringe retainer 30 for releasably retaining syringe 12 during the syringe filling operation. Such syringe 12, which is preferably of the size of single-use syringes that are factory-filled with viscoelastic material, may have a capacity of about one ml of fluid and may be about 5 to 10 cm long and have an outside diameter of about 0.5 to 1.0 cm.

Figures 1, 2, 4:
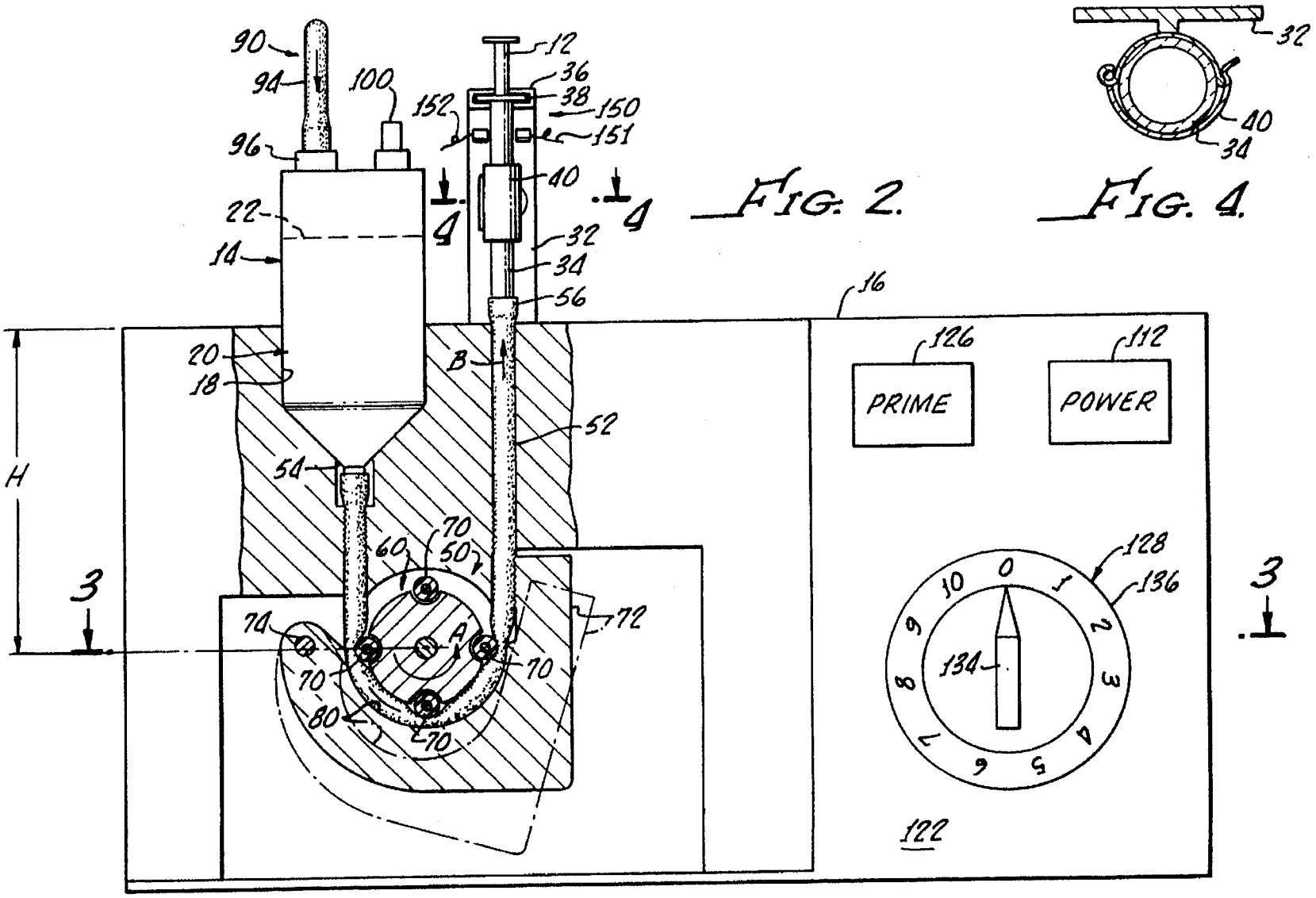
FIG. 2 is a partially cut-away drawing of the front side of the housing shown in FIG. 1 showing internal, viscoelastic pumping portions of the apparatus.
FIG. 4 is a transverse cross sectional drawing taken along line 4—4 of FIG. 1, showing features of the syringe retainer.

As shown in FIGS. 1 and 4, syringe retainer 30 comprises a half tube member 32 sized to receive, through its open side, a barrel region 34 of syringe 12, such member being formed having a shoulder 36 sized to receive a finger grip portion 38 of the syringe. A springy, releasable latching clip 40 is pivotally connected to a side region of member 32 for passing across the open side of member 32 and thereby retaining syringe 12 in syringe retainer 30 against filling forces while the syringe is being filled and until removal of the filled syringe, by first unlatching the clip, is desired.

Apparatus 10 includes viscoelastic fluid transfer means 50 for transferring viscoelastic material from supply reservoir 14 received into receiving port 20 into syringe 12 retained in syringe retainer 30 (FIGS. 1 and 2). Comprising viscoelastic fluid transfer means 50 is a flexible plastic tube 52 which is connected, for the filling operation, between a lower, discharge end 54 of supply reservoir 14 and a needle attaching end 56 of syringe 12. Further included in transfer means is a fluid pump 60 (FIGS. 1–3) which is disposed in housing 12 intermediate supply reservoir receiving port 14 and syringe retainer 30.

Figure 3:
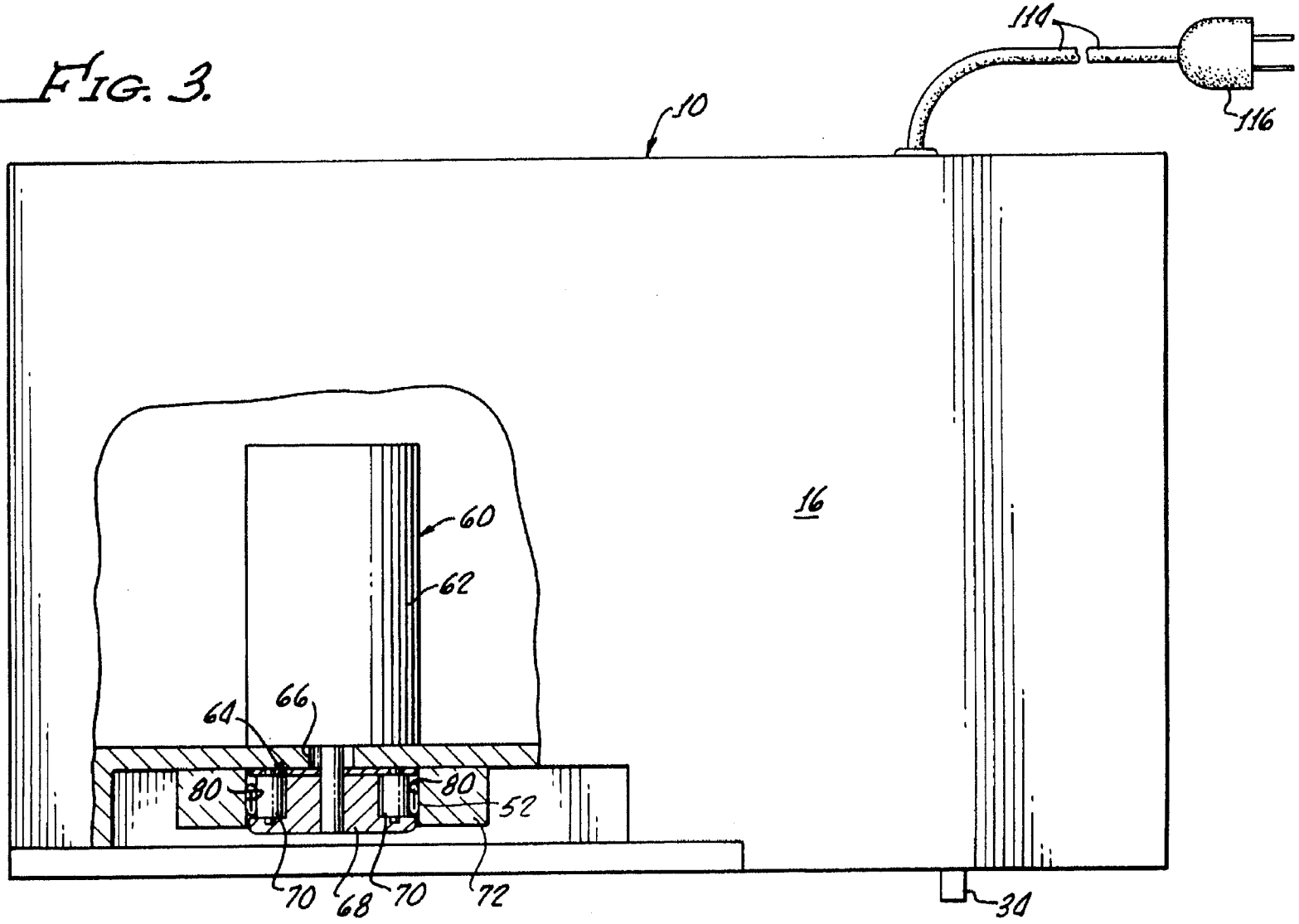
FIG. 3 is a partial transverse cross sectional drawing taken along line 3—3 of FIG. 2, showing additional features of the viscoelastic pump.

Preferably, and as depicted in FIG. 3, fluid pump 60 is a peristaltic pump having a motor 62 and a rotatably driven head assembly 64 connected to the motor by a shaft 66. Head assembly 64 comprises a cylindrical head 68 having a plurality of pumping rollers 70 pivotally mounted to peripheral regions thereof in a circumferentially spaced apart relationship relative to one another (FIG. 2). As shown, four of such pumping rollers 70 are provided at 90 degree intervals around pump head 68.

One end region of a rigid, generally L-shaped back-up member 72 is pivotally mounted, by a pivot pin 74, in housing 16 adjacent pump head assembly 64 (FIGS. 1 and 2). Back up member 72 is manually pivotal, about pin 74, between a closed position (shown in FIG. 1 and shown by a solid line in FIG. 2) and an open position (shown in phantom lines in FIG. 2). Member 72 is configured and is pivotally mounted by pivot pin 74 so that when the member is pivoted downwardly away from pump head assembly 64 to its open position, an arcuate pump-facing surface 80 of the member is spaced away from the pump head assembly a sufficient distance to enable transfer tube 52 to be installed or inserted between the pump head assembly and the member. Thereafter, when member 72 is pivoted back upwardly toward pump head assembly 64 to its closed position, tube 52 is retained between the pump head assembly and member surface 80 (FIGS. 2 and 3). A conventional latch 82 (FIG. 1) is provided for releasably retaining member 72 in its closed position.

When member 72 is in its closed position and is latched therein by latch 82, with portions of tube 52 entrained between pump head assembly 64 and member surface 80 and the pump head assembly is rotated in the direction of Arrow A (counter-clockwise, as shown in FIGS. 1 and 2), viscoelastic material contained in the tube is pumped through the tube from supply reservoir 14 received in port 18 to and into syringe 12 retained in syringe retainer 30 (direction of Arrow B, FIG. 2).

Depending on the viscosity of viscoelastic material 22 contained in supply reservoir 14, the fluid head, H (FIG. 2), may be insufficient to assure that tube 52 remains filled with the viscoelastic material during the above-described pumping operation. This could result in air voids or bubbles being formed in tube 52 and being thereby undesirably pumped into syringe 12.

To avoid this potential air entrapment problem, means 90 (FIG. 1) are preferably included in apparatus 10 for pressurizing viscoelastic supply reservoir 14 with sufficient pressure to assure that no voids or bubbles are formed in tube 52 or syringe 12 during the syringe filling procedure. As shown, pressurizing means 90 include an air pump 92 the output of which is connected by an air conduit 94 to an appropriate fitting 96 at the top of supply reservoir 14. It is therefore preferable that viscoelastic material 22 be provided in a sterile, collapsible plastic bag or bladder 98 so that the possibility of contamination of the viscoelastic material by foreign material in the pressurized air provided by air pump 92 is avoided. A pressure relief valve 100 is provided at the top of supply reservoir 14 to prevent over-pressurizing of the supply reservoir (FIGS. 1 and 2).

The above-described air pressurizing of viscoelastic supply reservoir 14 is desirable or even sometimes needed to aid in the filling of syringe 12 to the extent that air voids are prevented. However, it is not presently considered that the viscoelastic fluid transfer from supply reservoir 14 through tube 52 and into syringe 12 would properly be accomplished just by pressurizing the supply reservoir and without use of peristaltic pump 60. This is because a precise control of flow of the viscoelastic material is needed to fill small volume syringes with predetermined amounts of viscoelastic material.

Electric operating and control means 110 (FIG. 5) are included in apparatus 10 for enabling the power operation of the apparatus and for controlling such operation. Shown comprising electric operating and control means 110 are an A to D converter 112 which receives standard AC line voltage through an electrical conduit 114 having a conventional grounded, three pin connector plug 116 at its free end. Plug 116 is configured for plugging into a preexisting building power outlet 118. Electrically connected in conduit 114 is a conventional ON/OFF power switch 120 which, as shown in FIGS. 1 and 2, is accessible on a front surface 122 of apparatus housing 16.

Typically, building outlet 118 provides an AC output of 110 volts and A to D converter 112 provides an output of about 12 volts DC over an output conduit 124. A normally-open primer switch 126 and a normally-open material transfer pump timer switch 128 are connected in parallel to conduit 124 through conduits 130 and 132. Both switches 126 and 128 are accessible on housing front surface 122.

Primer switch 126 is configured so that when it is closed, it stays closed for a preestablished length of time, t1, and then automatically opens. This preestablished length of time, t1, is determined as the amount of time required for fluid transfer pump 60 to fill an empty fluid conduit 52 with viscoelastic material from viscoelastic supply reservoir 14.

Figure 5:
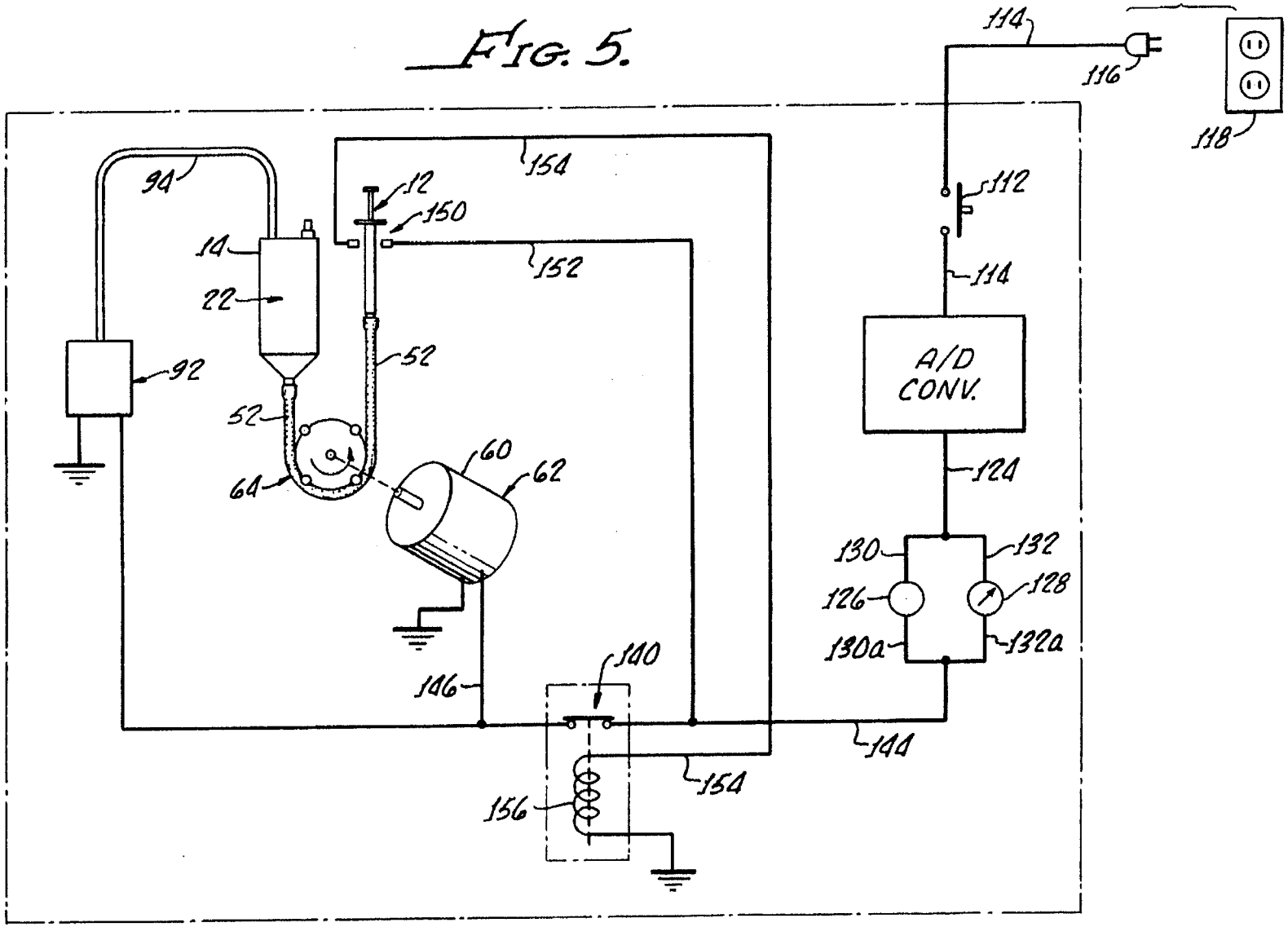
FIG. 5 is a diagram of electrical control portions of the apparatus. In the various FIGURES identical elements and features are given the same reference number.

Transfer pump timer switch 128 is a variable timer switch which is manually operated or set by an exposed, rotatable control member 134 (FIGS. 1, 2 and 5). Timer switch 128 has associated therewith a dial 136 which is preferably calibrated in milliliters (ml). Dial 136 may be formed as an exposed part of switch 128 (as shown) or may, alternatively, be marked on housing front surface around switch control member 124. The calibration of dial 136 corresponds to the amount of pump operating time required to fill a syringe 12 retained in syringe retainer 30 with the selected amount of viscoelastic material from supply reservoir 14.

When either primer switch 126 or pump timer switch 128 are closed, DC voltage from A to D converter 112 is conducted to normally-open contacts 140 of a control relay 142 over parallel conduits 130*a* and 132*a* and a common conduit 144. When relay contacts 140 are closed (as described below) and with one of switches 126 or 128 closed and power switch 120 closed, DC operating voltage is conducted from A to D converter 112 over an electrical conduit 146 to motor 62 of viscoelastic material transfer pump 60 and over an electrical conduit 148 to air pump 92.

Contacts 140 of control relay 142 are controlled by a normally-closed sensor 150 which is mounted on (or adjacent) syringe retainer 30 in a location to sense when a syringe 12 retained in the syringe retainer has been filled by transfer pump 60 to a predetermined, preferably a maximum-fill, level (FIG. 2). Sensor 150 may comprise a conventional position sensor, for example, a light-emitting diode and an associated photo cell or a Hall effect device, that conducts (is "ON") until the predetermined syringe fill level has been reached.

DC voltage is provided to one side of sensor 150 (when power switch 120 and one of primer switch 126 and pump timer switch 128 are closed) over a conduit 152 that is connected to the upstream side (side A) of relay contacts 140 (FIG. 5). Then, as long as sensor 150 remains closed, DC voltage is conducted from the sensor, over a conduit 154, to a operating coil 156 of relay 142, thereby causing the relay contacts to close and remain closed and enabling operation of transfer pump 60 and air pump 92.

OPERATION

The operation of apparatus 10 is readily apparent from the foregoing detailed description; nevertheless, a brief summary of the operation is presented below for purposes of clarity and for purposes of describing the method of on-site filling of syringes with a viscoelastic material.

Electrical plug 116 is plugged into building outlet 118. Viscoelastic supply reservoir 14, with tube 52 connected to the bottom thereof is inserted into receiving port 20, Backup member 72 is unlatched and pivoted downwardly in the direction of Arrow B to its open position (FIGS. 1 and 2). Intermediate regions of tube 52 are then inserted between backup member surface 80 and pump head assembly 64 and the backup member is pivoted back to its closed position and latched in place by latch 82. The free end of tube 52 is then threaded upwardly out of housing 16 into lower regions of syringe retainer 30 and the sealed end (not shown) is cut off.

Power switch 120 is then closed. If tube 52 is not already completely filled with viscoelastic material from supply reservoir 14, priming switch 126 is closed, thereby causing transfer pump 60 to operate for the predetermined length of time required to fill the tube. For such pumping operation, pump head assembly 64 is rotated by pump motor 62 in the direction of Arrow A so that pump head rollers 70 sequentially squeeze the region of tube 52 that is entrained between the pump head assembly and backup member 72 in a manner forcing viscoelastic material through the tube. In this priming operation, the duration of the pumping operation by pump 60 is determined by the time delay shut-off of priming switch 126.

It should be noted that according to the electric control configuration of FIG. 5, air pump 92 is operated in unison with transfer pump 60 so as to pressurize supply reservoir 14 and force viscoelastic material out of bladder 98 and into tube 52 so that it can be pumped by transfer pump 60. It should also be noted that sensor switch 150 will remain "closed" causing contacts 140 of relay 142 to remain closed and enabling the operation of pumps 60 and 92.

When tube 52 has been primed with viscoelastic material in the manner described above power switch 120 is turned "OFF." A syringe 12 is inserted in syringe retainer 30 and the free end of tube 52 is installed over end region 56 of the syringe. Syringe 12 is then latched into syringe retainer 30 by latch 40. Pump timer switch 128 is then adjusted by member 134 until the desired syringe fill volume is indicated on dial 136 (FIGS. 1 and 2). Power switch 120 is then turned "ON" and transfer pump 60 is powered until timer switch 128 shuts off automatically. As in the case of the above-described tube priming operation, air pump 90 is operated in unison with fluid transfer pump 60 to assist in the syringe filling operation.

While this syringe filling operation is being carried out, sensor switch 150 will remain closed, thereby enabling the syringe filling operation. In the event, however, of a malfunction in which transfer pump 60 does not shut off when the desired syringe fill level preset by timer switch 128 is reached, viscoelastic material will continue to be pumped into syringe 12. In such event, when the preestablished maximum fill level of syringe 12 is reached, switch 150 will be opened, relay coil 156 will then be deenergized and relay contacts 140 will open, thereby cutting power to both fluid transfer pump 60 and air pump 90 and stopping the syringe filling operation.

After the syringe filling operation is completed, power switch is turned "OFF" and the filled syringe 12 is unlatched and removed from syringe retainer 30. Assuming that supply reservoir 14 and tube 52 have not been emptied by the filling of syringe 12, system sterility, especially that of the viscoelastic material, must be maintained. Such sterility may be maintained by connecting a sterile, empty syringe 12 to the free end of tube 52, the empty syringe being latched into syringe retainer 30. Alternatively, the open end of tube 52 is sealed off with an appropriate sterile cap or stopper (not shown) to maintain sterility of the viscoelastic material.

By means of apparatus 10, syringes 12 are easily and quickly filled on site with viscoelastic material in the above-described manner.

Although there has been shown an on-site syringe filling apparatus and method, especially for the automated on-site filling of conventional syringes with a viscoelastic material from a viscoelastic reservoir, in accordance with a preferred embodiment of the present invention to illustrate the manner in which the invention may be used to advantage, it is to be appreciated that the invention is not limited thereto. Accordingly, any and all variations or equivalent arrangements which may occur to one of ordinary skill in the medical arts are to be considered to be within the scope and spirit of the claims as appended hereto.

Having now described the invention, what is claimed is:

1. A syringe filling apparatus for filling syringes with a viscoelastic material, said apparatus comprising:

a. reservoir receiving means for removably receiving an outlet end region of a supply reservoir of viscoelastic material;

b. a syringe retainer configured for receiving and releasably retaining a conventional medical syringe to be filled with viscoelastic material from a received viscoelastic supply reservoir; and c. viscoelastic material transfer means connected for transferring viscoelastic material from the outlet end region of a viscoelastic supply reservoir received in said reservoir receiving means to the discharge end region of a syringe received in said syringe retainer and from there into said syringe, said transfer means including a fluid conduit, comprising a flexible plastic tubing, configured for interconnecting the outlet end region of a viscoelastic supply reservoir installed in said reservoir retaining means with the discharge end region of a syringe installed in said syringe retainer, said viscoelastic material transfer means comprising a peristaltic pump having a rotatable pump head with a plurality of spaced apart pumping rollers mounted thereto for pumping viscoelastic material through said plastic tubing.

2. The syringe filling apparatus as claimed in claim 1, including a back-up member mounted adjacent to said pump head for pivotal movement between an open position in which a region of said plastic tubing can be placed between the back-up member and the pump head and a closed position in which rotation of the pump head by operation of said pump causes the pumping rollers to sequentially compress the flexible tubing disposed between the pump head and the back-up member in a manner causing the pumping of viscoelastic material through the tubing from a viscoelastic supply reservoir received into said receiving means into a syringe received into said syringe retainer.

3. The syringe filling apparatus as claimed in claim 2, wherein said peristaltic pump is configured for being electrically operated from an external electrical power source and including electrical controls connected for controlling the operation of said pump.

4. The syringe filling apparatus as claimed in claim 3, wherein the electrical controls are configured for enabling a priming operation of said pump so as to cause an initial filling of a tubing disposed between the pump head and the back-up member with viscoelastic material from a supply reservoir of viscoelastic material received in said reservoir receiving means before a syringe is installed in said syringe retainer.

5. The automated syringe filling apparatus as claimed in claim 3, wherein said electrical controls include a pump timer calibrated for varying amounts of viscoelastic material to be transferred by said pump from a viscoelastic supply reservoir received in said reservoir receiving means into a syringe installed in said syringe retainer.

6. The automated syringe filling apparatus as claimed in claim 3, wherein said electrical controls include a sensor mounted and operative for sensing when a syringe installed in the syringe retainer has been filled by operation of said pump to a preestablished fill level with viscoelastic material from a viscoelastic supply reservoir received in said receiving port and for shutting off said pump at said preestablished fill level.

7. The syringe filling apparatus as claimed in claim 6, wherein said flexible tubing is integrally formed at the outlet end region of a viscoelastic supply reservoir received into the reservoir receiving means.

8. A syringe filling apparatus for filling syringes with a viscoelastic material, said apparatus comprising:

a. reservoir receiving means for removably receiving an outlet end region of a supply reservoir of viscoelastic material;

b. a syringe retainer configured for receiving and releasably retaining a conventional medical syringe to be filled with viscoelastic material from a received viscoelastic supply reservoir;

c. viscoelastic material transfer means connected for transferring viscoelastic material from the outlet end region of a viscoelastic supply reservoir received in said reservoir receiving means to the discharge end region of a syringe received in said syringe retainer and from there into said syringe; and d. pressurizing means configured for pressurizing a viscoelastic supply reservoir received in said receiving port, said pressurizing means including an air pump and means for controlling said pump.

9. An automated syringe filling apparatus for filling syringes with a viscoelastic material, said apparatus comprising:

a. a housing having a receiving port configured for removably receiving an outlet end region of a supply reservoir of viscoelastic material and a syringe retainer configured for receiving and releasably retaining a conventional medical syringe to be filled from said viscoelastic supply reservoir;

b. means in the housing for receiving a flexible tubing for interconnecting the outlet end region of a viscoelastic supply reservoir installed in said receiving port with the discharge end region of a syringe installed in said syringe retainer;

c. a peristaltic pump mounted in said housing, said pump having a rotatable pump head with a plurality of circumferentially spaced apart pumping rollers mounted thereto and positioned for contacting regions of the tubing received in the housing;

d. a back-up member mounted in said housing adjacent said pumping rollers for pivotal movement between an open position in which a tubing disposed between the pump head and the back-up member is not significantly compressed by the pumping rollers when the pump head is rotated and a closed position in which a tubing disposed between the pump head and the backup member is compressed by the pumping rollers when the pump head is rotated so that when the pump head is rotated in the appropriate direction viscoelastic material contained in the tubing is caused to be pumped from a viscoelastic supply reservoir received into the first port toward and into a syringe received into said second port; and e. means configured and connectable for pressurizing a viscoelastic supply reservoir installed in said receiving port.

10. The automated syringe filling apparatus as claimed in claim 9, wherein said peristaltic pump is configured for being electrically operated from an external electrical power source and including electrical controls connected for controlling the operation of said pump, said electrical controls being connected for enabling an initial priming operation of said pump so as to cause, when a flexible tubing in installed between the pump head and the back-up member and the back-up member is in the closed position, an initial filling of said tubing from a viscoelastic supply reservoir received in said receiving port.

11. The automated syringe filling apparatus as claimed in claim 10, wherein said pressurizing means include an electrically-operated air pump and wherein said electrical controls are connected for operating said air pump in conjunction with operation of said peristaltic pump.

12. The automated syringe filling apparatus as claimed in claim 10, wherein said electrical controls include a pump timer calibrated for different amounts of viscoelastic material to be pumped by said peristaltic pump from a viscoelastic supply reservoir received in said receiving port into a syringe installed in said syringe retainer.

13. The automated syringe filling apparatus as claimed in claim 10, wherein said electrical controls include a sensor mounted and operative for sensing when a syringe installed in the syringe retainer has been filled by operation of said pump to a reestablished fill level with viscoelastic material from a viscoelastic supply reservoir received in said receiving port and for automatically stopping operation of said pump when said reestablished fill level of the syringe is sensed by the sensor.

14. The syringe filling apparatus as claimed in claim 9, wherein said flexible tubing is formed integrally with the viscoelastic supply reservoir at the outlet end region of said reservoir.

15. An automated, syringe filling apparatus for the on-site filling of syringes with a viscoelastic material from a supply reservoir of viscoelastic material, said supply reservoir having an elongate, flexible tube joined to the outlet end thereof, said apparatus comprising:

a. a housing assembly having a receiving port configured for receiving the outlet end region of the supply reservoir of viscoelastic material with the elongate tube thereof disposed within the housing;

b. a syringe retainer configured for receiving and retaining a conventional syringe to be filled from said viscoelastic supply reservoir, said syringe retainer causing a syringe installed therein to be retained in a fixed relationship with the outlet end region of a viscoelastic supply reservoir received in said receiving port;

c. an electrically operated viscoelastic fluid pump mounted in said housing, said fluid pump having a rotatable pump head with a plurality of spaced apart pumping rollers mounted thereto and positioned for contacting regions of the elongate tube received in the housing;

d. a back-up member mounted in said housing adjacent said fluid pump head for pivotal movement between an open position in which when said elongate tube is disposed between the fluid pump head and the back-up member and the pump head is rotated the tube is not significantly compressed by the pumping rollers, and a closed position in which the tube, when disposed between the fluid pump head and the backup member, is compressed by the pumping rollers when the fluid pump head is rotated so that material is pumped through the tube from the viscoelastic supply reservoir received into the receiving port toward and into a syringe installed in the syringe retainer;

e. an electrically-operated air pump configured for pressurizing a viscoelastic supply reservoir received in said receiving port; and f. electric controls connected for causing the selective operation of said viscoelastic fluid pump and rotation of said fluid pump head and for causing the operation of said air pump.

16. The automated syringe filling apparatus as claimed in claim 15, wherein said electrical controls are configured for enabling an initial priming operation of said viscoelastic fluid pump so as to cause, when a tube portion of a viscoelastic supply reservoir is disposed between the fluid pump head and the back-up member and the back-up member is in the closed position, the initial filling of said tube with viscoelastic material from said supply reservoir.

17. The automated syringe filling apparatus as claimed in claim 16, wherein said electrical controls include a manually-selectable fluid pump timer calibrated for different amounts of viscoelastic material to be pumped by said fluid pump from a viscoelastic supply reservoir received in said receiving port to a syringe installed in said syringe retainer.

18. The automated syringe filling apparatus as claimed in claim 17, wherein said electrical controls are operative for operating said air pump when said fluid pump is operated.

19. The automated syringe filling apparatus as claimed in claim 16, wherein said electrical controls include a sensor mounted and operative for sensing when a syringe installed in the syringe retainer has been filled by operation of said fluid pump to a preestablished fill level with viscoelastic material from a viscoelastic supply reservoir received in said receiving port and for automatically shutting off said fluid pump when a syringe installed in the syringe retainer has been filled with viscoelastic material to said preestablished fill level.

20. A method for the on-site filling of a syringe with a viscoelastic material, said method comprising the steps of:

a. providing a supply reservoir of a viscoelastic material to be used in filling a syringe;

b. connecting the needle-attachment end of a syringe to the outlet end of said reservoir through a fluid conduit; and c. flowing viscoelastic material through said conduit from the viscoelastic supply reservoir into said syringe.

21. The method for the on-site filling of a syringe as claimed in claim 20, including the step of pressurizing said viscoelastic supply reservoir to aid in flowing of viscoelastic material from the supply reservoir into said syringe.

22. The method for the on-site filling of a syringe as claimed in claim 20, including the step of initially filling said fluid conduit with viscoelastic material from said supply reservoir before connecting a syringe to said tube.

23. The method for the on-site filling of a syringe as claimed in claim 20, including the step of forming said fluid conduit integrally with an outlet region of said viscoelastic supply reservoir.

24. The method for the on-site filling of a syringe as claimed in claim 20, including the step of releasably retaining said syringe in a fixed position relative to said viscoelastic supply reservoir while the syringe is being filled with viscoelastic material from said supply reservoir.

25. The method for the on-site filling of a syringe as claimed in claim 20, including the step of forming said conduit of a flexible plastic tube and wherein the step of flowing viscoelastic material though the conduit includes the step of progressively squeezing said flexible plastic tube in a manner causing the flow therethrough of viscoelastic material from the viscoelastic supply reservoir into said syringe.

26. The method for the on-site filling of a syringe as claimed in claim 25, wherein the step of squeezing the plastic tube includes pumping the viscoelastic material through the tube with a peristaltic fluid pump having pump head rollers for causing a sweeping squeezing of the tube when the pump is operated.

27. The method for the on-site filling of a syringe as claimed in claim 26, including the step of controlling operation of the fluid pump so that only a predetermined amount of viscoelastic material is pumped into the connected syringe.

28. The method for the on-site filling of a syringe as claimed in claim 27, including the steps of sensing when the amount of viscoelastic material being pumped by the fluid pump into said syringe reaches a preestablished fill level and automatically shutting off the fluid pump when said preestablished fill level has been reached.

29. The method for the on-site filling of a syringe as claimed in claim 20, including the step of releasably retaining the syringe in a fixed relationship relative to said supply reservoir while said syringe is being filled by the fluid pump.

* * * * *